US007536123B2

(12) United States Patent
Kurita et al.

(10) Patent No.: US 7,536,123 B2
(45) Date of Patent: May 19, 2009

(54) IMAGE FORMING APPARATUS, METHOD OF RECOMMENDING REPLACEMENT OF ROTATABLE MEMBER, METHOD OF CLEANING ROTATABLE MEMBER AND METHOD OF CONTROLLING IMAGE FORMATION

(75) Inventors: Atsumi Kurita, Kanagawa (JP); Tetsuo Yamada, Kanagawa (JP); Tohru Inoue, Kanagawa (JP); Aya Kakishima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 323 days.

(21) Appl. No.: 11/652,026

(22) Filed: Jan. 11, 2007

(65) Prior Publication Data

US 2008/0008482 A1 Jan. 10, 2008

(30) Foreign Application Priority Data

Jul. 7, 2006 (JP) ..... 2006-187473

(51) Int. Cl.
*G03G 15/20* (2006.01)

(52) U.S. Cl. ..... 399/33; 399/327; 399/333

(58) Field of Classification Search ..... 399/33, 399/71, 327, 328, 333, 343
See application file for complete search history.

(56) References Cited

U.S. PATENT DOCUMENTS 6,347,211 B2 * 2/2002 Nanataki et al. ..... 399/328

FOREIGN PATENT DOCUMENTS

| | | | |
|---|---|---|---|
| JP | 04-314077 | * | 11/1992 |
| JP | 05-223513 | * | 8/1993 |
| JP | A-2003-337492 | | 11/2003 |

* cited by examiner

*Primary Examiner*—Hoang Ngo
(74) *Attorney, Agent, or Firm*—Morgan, Lewis, & Bockius LLP

(57) ABSTRACT

An image forming apparatus includes: an imaging device that forms a toner image based on image data and transfers the toner image to a recording medium; a fixing device including a pair of rotatable members that defines a contact pressing portion that allows the recording medium with the toner image to pass through, and heats and presses the recording medium with the toner image; a surface potential measuring device that measures a surface potential of at least one of the pair of rotatable members; and a controller that performs control to give an alert notification that at least one of the pair of rotatable members which contacts with the toner image to be fixed should be replaced, when a result of the surface potential measured by the surface potential measuring device has exceeded a predetermined value.

18 Claims, 12 Drawing Sheets

| SURFACE POTENTIAL OF HEATING ROLLER | TONER OFFSET |
|---|---|
| -25V (INITIAL STAGE) | DOES NOT OCCUR |
| -10V | DOES NOT OCCUR |
| -5V | SOMEWHAT OCCURS |
| +5V | OCCURS |
| +15V | OCCURS |

IMAGE FORMING APPARATUS, METHOD OF RECOMMENDING REPLACEMENT OF ROTATABLE MEMBER, METHOD OF CLEANING ROTATABLE MEMBER AND METHOD OF CONTROLLING IMAGE FORMATION

CROSS-REFERENCE TO RELATED APPLICATIONS

This application is based on and claims priority under 35 USC 119 from Japanese Patent Application No. 2006-187473 filed Jul. 7, 2006.

BACKGROUND

1. Technical Field

The present invention relates to image forming apparatus that forms an image with dry toner (developing powders), such as printers, copiers, facsimiles, and hybrid machines as well as a method of recommending replacement of a rotatable member, a method of cleaning a rotatable member, and a method of controlling image formation. Particularly, the invention relates to an image forming apparatus provided with a new function for preventing toner offset from occurring in a fusing device that fuses and fixes a toner image transferred onto a sheet of paper as well as a method of recommending replacement of a rotatable member, a method of cleaning a rotatable member, and a method of controlling image formation.

2. Related Art

An image forming apparatus such as printers applying an electrophotographic method or an electrostatic recording method generally forms an image with dry toner on a sheet of paper in the following way.

First, based on image data, a toner image is formed on an image carrying member such as a photo conductor through a predetermined imaging process (including charging, exposure, and development steps). The toner image is transferred to a sheet of certain paper directly or via an intermediate transferring member. Then, by exerting heat and pressure on the sheet having the toner image transferred thereto, a fusing device thermally fixes. the toner image to the sheet. As the fusing device, such a type is widely used at the present that employs a pair of rotatable members for image fixing (e.g., a heating roller and a pressure roller) that defines a contact pressing portion that heats and presses the sheet with the toner image transferred thereto, guided to pass through it, thereby fusing and fixing the toner image to the sheet.

In such image forming apparatus, it is practiced to form a release layer made of a fluorinated resin or the like on the surfaces of the rotatable members for image fixing in the fusing device to improve the releasability of the rotatable members. However, there may occur a phenomenon, which is so-called toner offset, in which some of toner not yet fixed to the sheet transfers and clings to the surfaces of the rotatable members for image fixing with the release layer formed thereon. If the toner offset occurs in the fusing device, the toner offset to the rotatable members for image fixing would be deposited onto a sheet passing through the contact pressing portion for subsequent image fixing. This poses problems such as a stain on a sheet and a blurred part of a fixed image resulting in a defective image.

As measures to eliminate the problems associated with toner offset occurrence, it has heretofore been carried out that a cleaning device is installed at the rotatable members for image fixing to remove the toner offset to the rotatable members. However, in a case where a type of paper (such as acid-free paper) including calcium carbonate as a loading filler, for which demand has grown recently, is used, the calcium carbonate particles adhere to the rotatable members for image fixing. This poses new programs such as a decrease in the releasability and toner offset occurring due to the calcium carbonate particles adhered to the rotatable members.

SUMMARY

According to an aspect of the present invention, an image forming apparatus includes: an imaging device that forms a toner image based on image data and transfers the toner image to a recording medium; a fixing device including a pair of rotatable members that defines a contact pressing portion that allows the recording medium with the toner image to pass through, and heats and presses the recording medium with the toner image; a surface potential measuring device that measures a surface potential of at least one of the pair of rotatable members; and a controller that performs control to give an alert notification that at least one of the pair of rotatable members which contacts with the toner image to be fixed should be replaced, when a result of the surface potential measured by the surface potential measuring device has exceeded a predetermined value.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
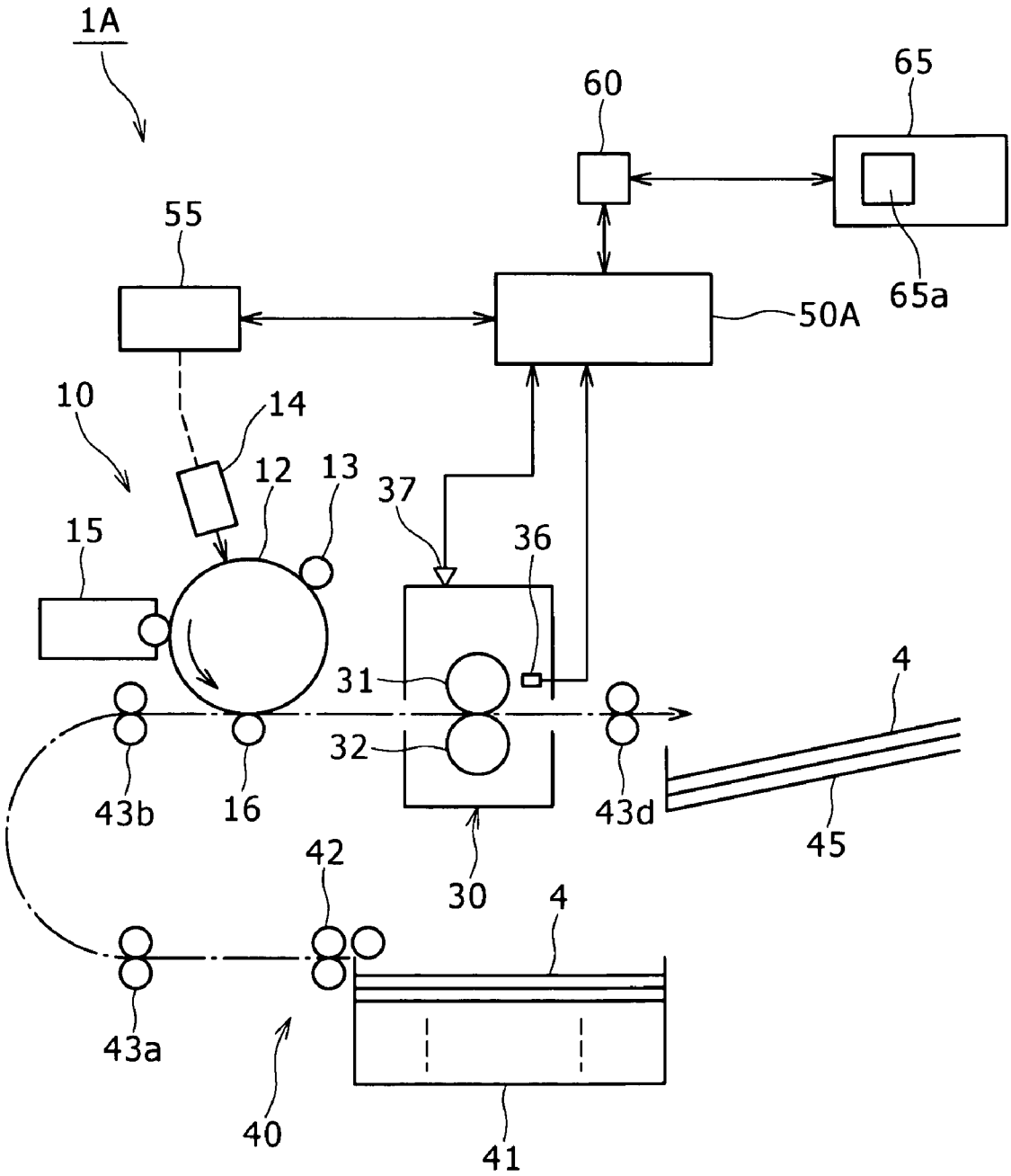
FIG. 1 is a schematic diagram showing primary elements of an image forming apparatus relevant to a first exemplary embodiment.

FIG. 1 shows an overview of an image forming apparatus relevant to a first exemplary embodiment of the present invention.

This image forming apparatus 1A is configured as a printer, for example, and, inside its mainframe which is not shown, the apparatus is primarily equipped with an imaging device 10 which forms a toner image based on image data and transfers the toner image to a sheet 4 of paper, a fixing device 30 which thermally fixes the toner image transferred to the sheet 4 guided to pass through it, and a paper feeding device 40 which feeds the sheet 4 to the imaging device 10, and a controller 50A which is responsible for overall control for an image forming operation by the imaging device 10, the fixing device 30, the paper feeding device 40, and other components. In FIG. 1 and a related description, reference numeral 65*a* denotes a display such as a liquid crystal panel and a chain line with an arrow indicates a transport path of the sheet 4.

In this image forming apparatus 1A, an image reader which is not shown, external equipment such as a personal computer, readers of various types of storage media, an operation and display console 65 for input, selection, and display of data related to the operation of the image forming apparatus 1A may be installed outside or connected to the mainframe of the apparatus via a receiver 60 having a communication function. If this image forming apparatus is configured as a copier or a hybrid machine which also has a copy function, the image reader is always installed included in the configuration.

The imaging device 10 may be configured by, for example, using a publicly known electrophotographic method. In particular, the imaging device includes a photoconductor drum 12 which is a cylindrical drum running in the arrow direction. Around the photoconductor drum 12, a charging unit 13 formed of a charging roller or the like which evenly charges the surface of the photoconductor drum 12, an exposure unit 14 formed of an array of LEDs, a laser scanner, or the like, which illuminates the charged surface of the photoconductor drum 12 with imaging light based on image data (signals), thus forming a latent image having a potential difference on the drum surface, a development unit 15 which forms a toner image by applying toner to the latent image, a transfer unit 16 formed of a transfer roller or the like which transfers the toner image onto a sheet 4 of paper supplied from the paper feeding device 40 are arranged.

Figure 2:
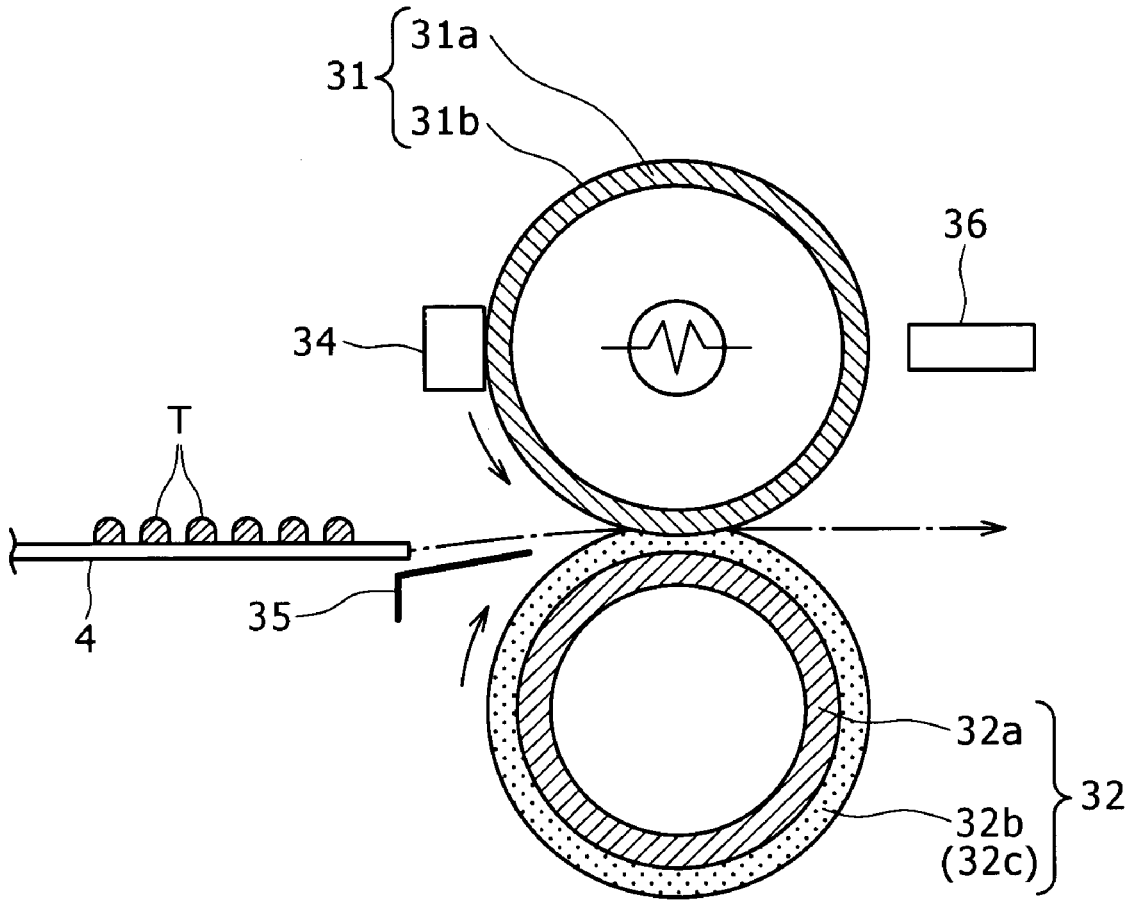
FIG. 2 is a schematic diagram showing primary elements of a fixing device used in the image forming apparatus of FIG. 1.

As shown in FIG. 1 and FIG. 2, the fixing device 30 is equipped with a heating roller 31 which runs and drives in the arrow direction and a pressure roller 32 which runs, driven while being pressed against the heating roller 31 substantially along the axial line direction of the heating roller 31. A contact pressing portion (fixing nip) NP is defined between both rollers and the sheet 4 having the toner image transferred thereto is guided into and passes through this portion. Reference numeral 35 in FIG. 2 denotes an entrance guide for guiding the sheet 4 with the toner image T transferred thereto, which is subjected to fixing, into the contact pressing portion NP.

The heating roller 31 may have a structure in which a release layer 31*b* made of a fluorinated resin such as pertetra fluoroethylene (PTFE), perfluoroarkosine (PFA), or the like is formed on a cylindrical metal roller 31*a* or a structure in which a heat-resistant elastic body layer made of silicone rubber or the like is formed on the roller. The heating roller 31 has a heating source 33 such as a halogen heater installed inside the roller and a temperature sensor 34 for measuring the temperature of the roller surface is positioned thereon. While the surface temperature is sensed by the temperature sensor 34, the heating roller 31 is controlled to be heated and maintained at a predetermined temperature. On the other hand, the pressure roller 32 may have a structure in which an elastic layer 32*b* made of silicone rubber, fluoro-rubber, or the like is formed on a metal roller base material 32*a* or a structure in which a release layer 32*c* made of a fluorinated resin such as PTFE, PFA, or the like is further formed on the elastic layer 32*b*. The pressure roller 32 is supported by a pressure exerting mechanism which is not shown so that it is pressed against the heating roller 21 by a predetermined pressure.

The paper feeding device 40 is equipped with a paper cassette 41 in which multiple sheets 4 of paper to be supplied are stacked and contained and a feeding mechanism 42 which feeds each sheet 4 contained in the paper cassette 41. There may be multiple paper cassettes 41 as required. The paper feeding device 40 is also equipped with a paper transport path which is made up of paper transport roller pairs 43*a*, 43*b*, . . . , guide members, and the like for transporting a sheet 4 from the paper cassette 41 to the transfer section of the imaging device 10 (between the photoconductor drum 12 and the transfer unit 16). The paper transport path extends from the imaging device 10 to the fixing device 30 and from the fixing device 30 to a paper ejection unit (such as a tray) 45. For example, a pair of ejection rollers 43*d* is located at the paper output side of the fixing device 30 to allow a sheet after fixing to roller out to the paper ejection unit 45.

The controller 50A is composed of arithmetic processing circuits, a control circuit, memories (such as various types of memories and a hard disk), and other elements. The controller 50A is adapted to control the operations of the imaging device 10, the fixing device 30, the paper feeding device 40, etc. related to an image forming operation by operating the arithmetic processing circuits and the like in accordance with a control program or data stored in the memories, upon input of sensing information from various sensors or a command from external equipment or the operation console 65. Also, an image processing device 55 is connected to the controller 50A. The image processing device 55 performs predetermined image processing on image data (signals) input from external equipment via the receiver 60 or image data (signals) read by the image reader and sends processed image signals to the imaging device 10 and the exposure unit 14 as required. The operation of this image processing device 55 is also controlled by the controller 50A.

Figure 3:
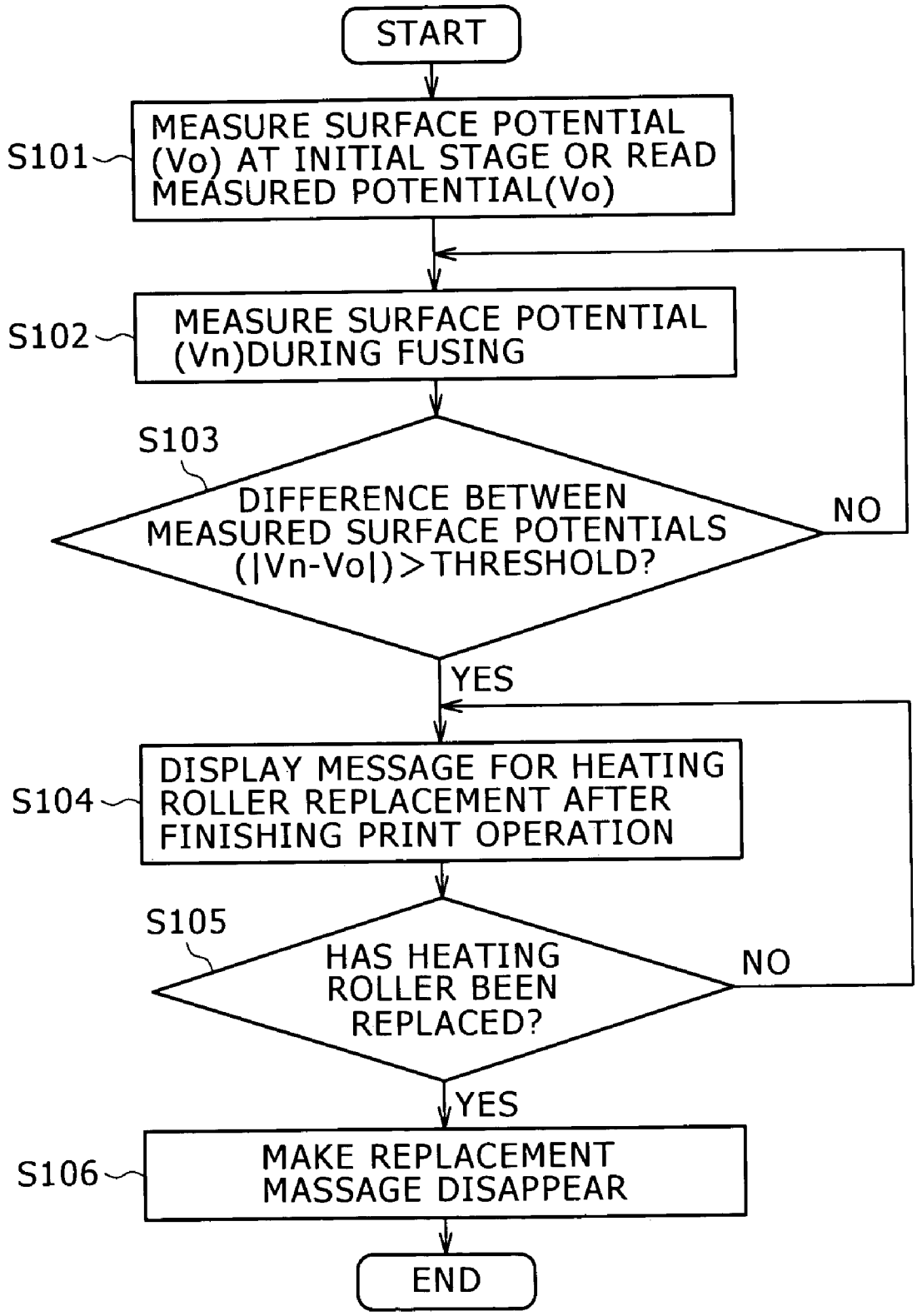
FIG. 3 is a flowchart illustrating a control operation for preventing toner offset by a controller in the image forming apparatus of FIG. 1.

In the image forming apparatus 1A, as shown in FIG. 1 and FIG. 2, a surface potential measuring device 36 which measures the surface potential of the heating roller 31 in the fixing device 30 is installed and connected to the controller 50A so that a result of measurement performed by the surface potential measuring device 36 is input to the controller 50A. The apparatus is configured such that the controller 50A performs a control operation for preventing toner offset, as illustrated in FIG. 3, according to the result of detection made by the surface potential measuring device 36. The control program for this control operation is stored in a memory for the controller 50A.

The control operation by the controller 50A according to the result of detection made by the surface potential measuring device 36 in this exemplary embodiment first causes the surface potential measuring device 36 to execute the measurement of the surface potential of the heating roller 31 at the initial stage and the measurement of the surface potential of the heating roller 31 during a fixing operation. The surface potential data measured by the surface potential measuring device 36 is stored into the memory for the controller 50A. The controller 50A calculates a difference ΔV ($|V_n-V_0|$) between the surface potential ($V_0$) of the heating roller 31 at the initial stage and the surface potential ($V_n$) thereof during fixing, whenever the fixing operation takes place or each time fixing for a predetermined number of sheets has been finished and determines whether the value of the difference ΔV has exceeded a threshold value α. If the difference has exceeded the threshold value, the controller 50A causes the operation and display console 65 to perform an operation of displaying a message that the heating roller 31 should be replaced.

As for the threshold value α, actual measurements of the surface potential causing toner offset occurrence are investigated and the threshold is set to a value obtained as the difference ΔV ($|V_x-V_0|$) between the surface potential $V_x$ when a small amount of toner offset starts to occur and the surface potential $V_0$ at the initial stage. In this example, a replacement sensor 37 is attached to the fixing device 30 to detect whether the heating roller 32 of the fixing device 30 has actually been replaced when the above replacement message is displayed.

Using this image forming apparatus 1A, tests have been performed as will be described below.

Figures 4, 5:
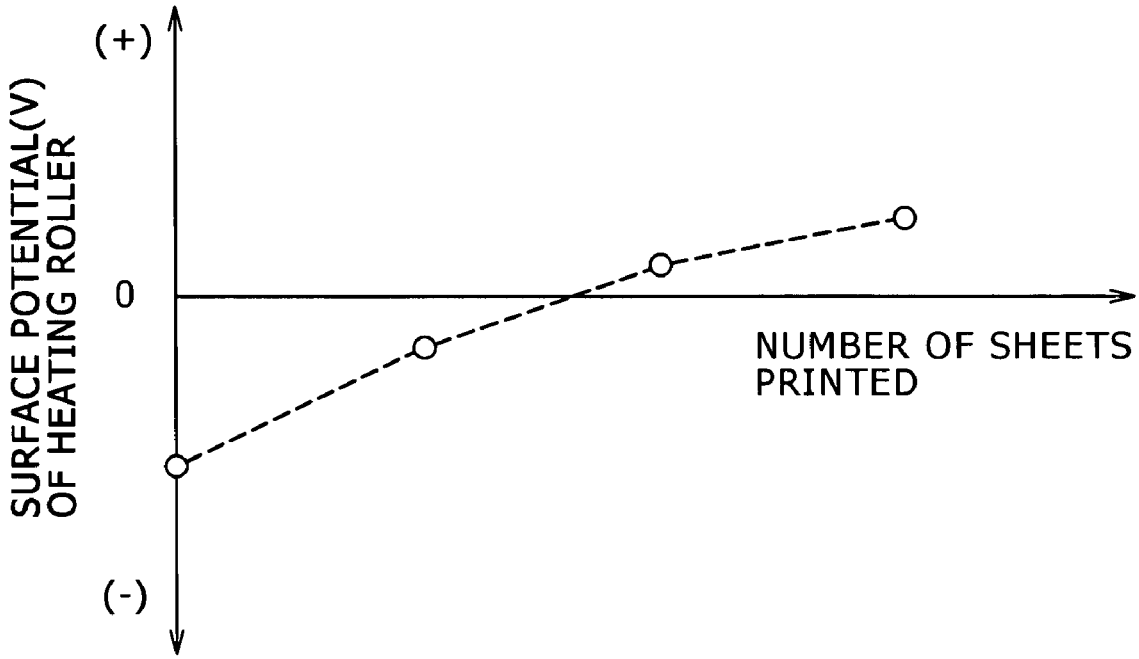
FIG. 4 is a graph showing the result of a test made to investigate a relationship between the number of sheets printed and the surface potential of a heating roller.
FIG. 5 is a table showing the result of a test made to investigate a relationship between the surface potential of the heating roller and toner occurrence.

FIG. 4 shows the result of Test 1 that has been performed to investigate change in the surface potential of the heating roller 31 in the fixing device 30 when a print operation has been performed by the image forming apparatus 1A The details and operating conditions of the fixing device 30 used in Test 1 are specified below. The heating roller 31 with an outside diameter of 65 mm is used, which has a release layer 31*b* with a thickness of 36 μm formed by baking and plating a resin composition made of PFA including 8% by weight of silica carbide (SiC) as the loading filler on a cylindrical aluminum base material 31*a*. The heating roller 31 is heated and maintained at 170° C. during fusing and is driven to revolve so that a sheet moves on it at 460 mm/sec. The pressure roller 32 with an outside diameter of 65 mm is used, which has a heat-resistant elastic body layer 32*b* with a thickness of 12 μm, made of silicone rubber, formed on a cylindrical aluminum base material 32*a*. The pressure roller 32 is installed so as to be contact pressed against the heating roller 31 at a contact pressure of 6 kgf/cm$^2$ (≈60 N/cm$^2$). As the surface potential measuring device 36, Model 1344 supplied from Trek Inc. is used. Its probe is installed so as not to contact with the surface of the heating roller 31 at the paper eject side of the contact pressing portion NP. In Test 1, acid-free paper (Green 100 supplied Fuji Xerox Co., Ltd.) is used as sheets 4 of paper. As the toner, negative electric toner made of acrylic styrene with an average particle diameter of 5.8 μm is used.

Test 1 printed halftone images by the image forming apparatus configured as described above and performed the surface potential measurement each time printing of 2000 sheets has been finished. Its result is shown in FIG. 4.

As show in FIG. 4, it has been found that the surface potential of the heating roller 31 changes gradually from negative to positive potential (voltage) as the number of prints increases. By observation of the surface of the heating roller 31 after the test by FT-IR analysis (microscopical infrared emission spectroscopy or Fourier Transform infrared spectrophotometer analysis) it has been detected that particles including calcium carbonate from the paper adhere to the roller surface. It has turned out that negatively charged toner particles tend to easily adhere to the heating roller 31 with a positive surface potential by effect of electrostatic attraction and toner offset is liable to occur in this state.

FIG. 5 shows the result of Test 2 made to investigate a relationship between the surface potential of the heating roller 31 in the fixing device 30 and toner offset occurrence in a print operation performed by the image forming apparatus 1A.

Test 2 has carried out a print under the same condition as the above Test 1 and investigated whether toner offset has occurred and toner offset condition in connection with different values of the surface potential of the heating roller 31 as specified in FIG. 5. It result is shown in FIG. 5.

From the result of FIG. 5, no toner offset occurs as the surface potential of heating roller 31 is from its initial surface potential (−25 V) to −10 V. However, when the surface potential reaches at least +5 V, toner offset starts to occur. From this fact, the above threshold value α is set at "15 V" that corresponds to the difference between the initial surface potential ($V_0$ =−25V) and the surface potential ($V_x$=−10V) when a small amount of toner offset is assumed to start to occur (in other words, a potential level just below the potential measured when offset occurrence is detected).

Next, the operations of the image forming apparatus 1A are described.

First, a basic image forming (printing) operation is described. When the image forming apparatus 1A receives a command to form an image (print instruction) from external equipment, the operation and display console 65, or the like, the photoconductor drum 12 in the imaging device 10 runs. After the drum is charged at a predetermined potential by the charging unit 13, an electrostatic latent image is formed on the drum by imaging light illumination and scan on the photoconductor drum 12 from the exposure unit 14, based on image signals output from the image processing device 55. Then, the latent image is developed into a toner image by toner application as it passes under the development unit 15. Subsequently, when the toner image moves to the transfer section defined by the opposite side contacting the transfer unit 16, the toner image is electrostatically transferred onto a sheet 4 of paper fed into the transfer section at a predetermined timing by registration rollers 43*b* after transported from the paper feeding device 40.

As the sheet 4 having the toner image transferred thereto is guided to pass through the contact pressing portion NP between the heating roller 31 and the pressure roller 32 of the fixing device 30, it is heated and pressed and the toner image is thermally fixed to the sheet 4. Then, the sheet 4 with the fixed image is ejected to the paper ejection unit 45 by the ejection rollers 43*d* and placed on top of a stack of previously printed sheets. In this way, the basic image formation on one sheet is completed. If images are printed on multiple sheets successively, the above printing operation is repeated continuously.

Subsequently, as such print operation is repeated, particles adhering to a sheet 3 tends to transfer and cling to the surface of the heating roller 31 of the fixing device 30. The presence of these particles results in a condition where toner offset is liable to occur as described above.

In the image forming apparatus 1A, by the execution of control which will be described later, an image after rotated is output at given intervals N. As a result, particles adhered to the surface of the heating roller 21 are removed and distributed across the surface area of the roller.

Next, the control operation for preventing toner offset by the controller 50A is described with reference to FIG. 3.

In the fixing device 30, first, the surface potential ($V_0$) of the heating roller 31 at the initial stage (at new product installation) is measured by the surface potential measuring device 36 at the start of a print operation (step S101). The measured value ($V_0$) is sent to the controller 50A, stored into its memory, and preserved (until the heating roller 31 is replaced) The measured value ($V_0$) is read when a decision is made in the subsequent control stage (S101).

During a fixing operation in printing, the surface potential ($V_n$) of the heating roller 31 is measured at any given point of time (S102) and the measured value is sent to the controller 50A.

When a time of detection as noted above comes, the controller 50A calculates the difference ΔV ($|V_n-V_0|$) for the surface potential of the heating roller 31 and determines whether the difference ΔV exceeds the threshold value α (15 V in this example) (S103).

At this time, if it is determined that the difference ΔV for the surface potential of the heating roller 31 has exceeded the threshold value α (ΔV>α) the heating roller 31 is regarded as being in the condition where offset is liable to occur (involving a condition where calcium carbonate particles adhere to the roller), and the controller 50A instructs the operation and display console to display a message that the heating roller 31 of the fixing device 30 should be replaced on the display 65*a*, after finishing all the remaining print operation in a series of print jobs requested (S104).

Noting the heating roller replacement message displayed on the display 65*a*, the user or the like may replace the heating roller 31 of the fixing device 30. This replacement may be carried out by removing the fixing device 30 from the mainframe of the image forming apparatus, replacing only the heating roller 31 with a new one, and reinstalling the fixing device in the mainframe of the image forming apparatus, or by replacing the fixing device 30 as a whole with a new one.

After displaying the replacement message, the controller 50A checks whether the heating roller 31 has actually been replaced, based on the result of detection made by the replacement sensor 37 (S105). As long as the replacement is not detected, the above replacement message continues to be displayed until the replacement has been detected. If the replacement is detected, the controller 50A instructs the operation and display console 65 to make the above replacement message disappear (S106).

Otherwise, if the difference ΔV for the surface potential of the heating roller 31 does not exceeds the threshold value α (ΔV≦α), as determined at step S103, steps S102 and S103 are repeated and the remaining print operation (including the fixing operation) continues as usual.

In this way, in the case where the difference ΔV for the surface potential of the heating roller 31 has exceeded the threshold value α, the message to replace the heating roller 31 is displayed. Accordingly, the heating roller 31 is replaced with a new one. Consequently, in the fixing device 30, the heating roller 31 that is put in the condition where the offset is liable to occur is replaced with a new heating roller 31 and, therefore, the offset can be prevented from occurring.

Second Exemplary Embodiment

Figure 6:
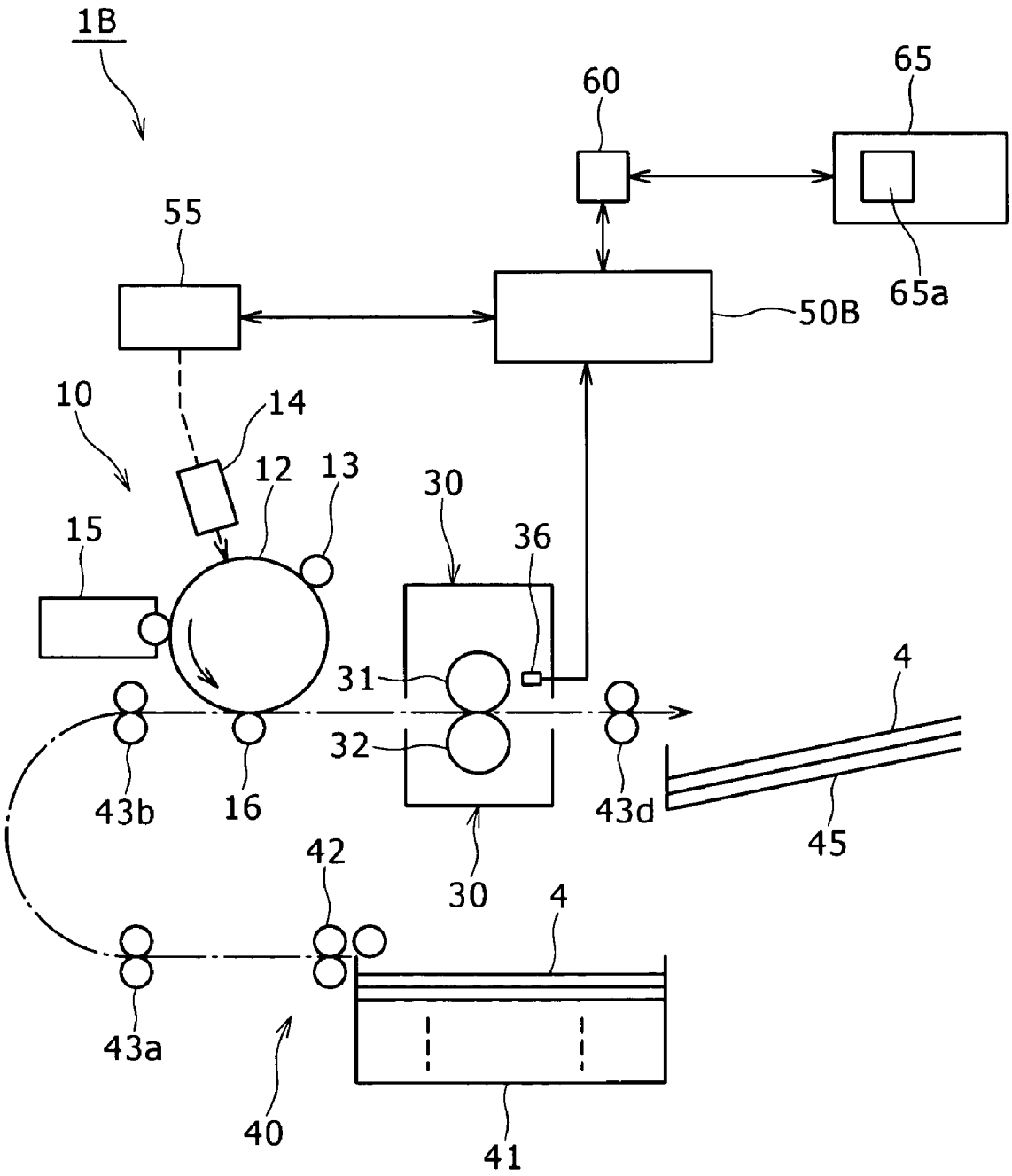
FIG. 6 is a schematic diagram showing primary elements of an image forming apparatus relevant to a second exemplary embodiment.

FIG. 6 shows an overview of an image forming apparatus relevant to a second exemplary embodiment of the present invention.

This image forming apparatus 1B is made up of the same components as those of the image forming apparatus 1A relevant to the first exemplary embodiment, except that a controller 50B is applied; a part of its control operation for preventing toner offset differs. Thus, the components corresponding to those of the image forming apparatus 1A relevant to the first exemplary embodiment are assigned the same reference numerals in FIG. 6 and a related description and their explanation will not be repeated in the following, unless necessary.

Figure 7:
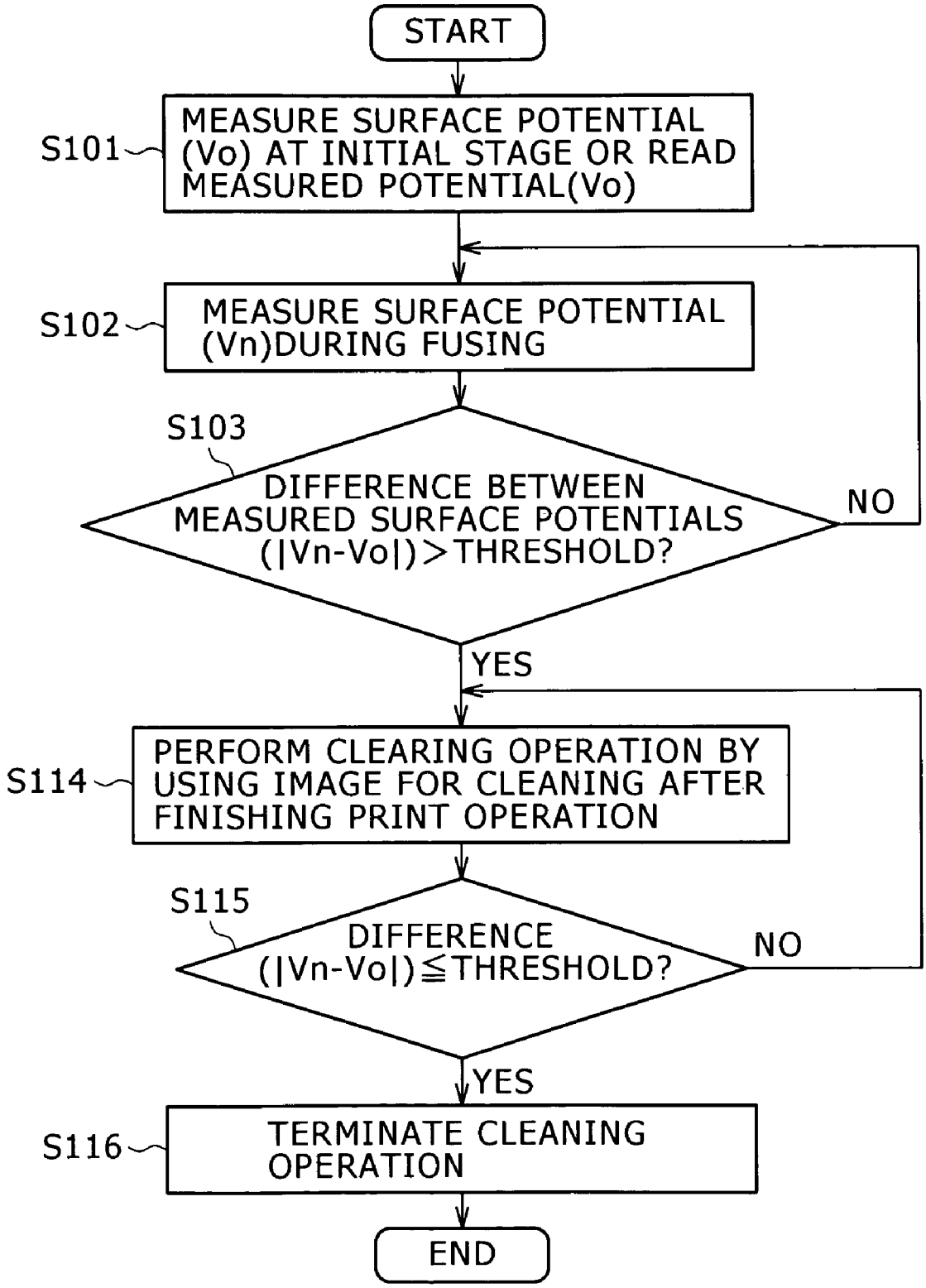
FIG. 7 is a flowchart illustrating a control operation for preventing toner offset by a controller in the image forming apparatus of FIG. 6.

The controller 50B in the second exemplary embodiment is adapted to carry out the control operation for preventing toner offset as illustrated in FIG. 7, according to the result of detection made by the surface potential measuring device 36 which measures the surface potential of the heating roller 31 of the fixing device 30. In particular, the controller 50B calculates the difference ΔV ($|V_n-V_0|$) between the surface potential ($V_0$) of the heating roller 31 at the initial stage and the surface potential ($V_n$) thereof during fixing, whenever the fixing operation takes place or each time fixing for a predetermined number of sheets has been finished and determines whether the value of the difference ΔV has exceeded a threshold value α. If the difference has exceeded the threshold value, the controller 50A invokes an operation for cleaning the heating roller 31.

Figure 8:
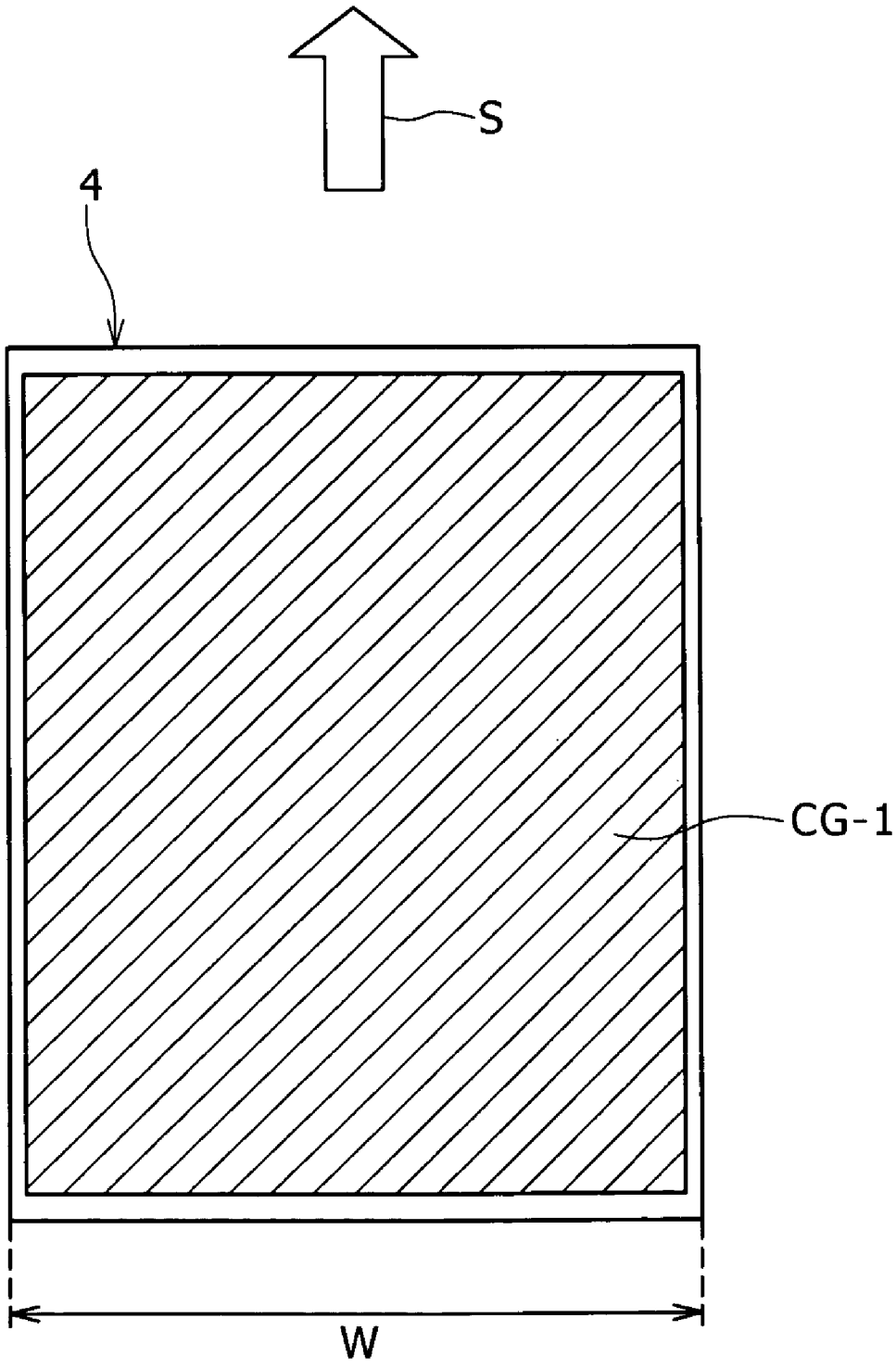
FIG. 8 is a plan view showing an example of an image pattern (full solid image) for cleaning.

In this example, the operation for cleaning the heating roller is such that a solid image CG-1 for cleaning as shown in FIG. 8 is formed and transferred to all the surface area of a sheet 4 of paper by the imaging device 10 and the sheet 4 having the full solid image CG-1 transferred thereto is guided to pass through the contact pressing portion NP defined between the heating roller 31 and the pressure roller 32 in the fixing device 30.

This full solid image CG-1 for cleaning is stored in the memory for the controller 50B or optionally may be stored in the image processing device 55. For the sheet 4 on which the solid image CG-1 for cleaning is formed, a sheet that has a width (width in the feeding direction S) W corresponding to the maximum effective width for fixing (width in the axial direction of the rollers) of the contact pressing portion NP in the fixing device 30 is used. Moreover, the cleaning operation using the solid image pattern for cleaning is set as follows: after the execution of printing the image on one sheet or multiple sheets 4, it is checked whether the above difference ΔV for the surface potential of the heating roller 31 falls below the threshold value α, and the cleaning operation is terminated when the difference has fallen below the threshold value α.

Next, the control operation for preventing toner offset by the controller 50B in the image forming apparatus 1B is described with reference to FIG. 7.

First, the initial steps of the control operation by the controller 50A in the first exemplary embodiment (steps S101 to S103 in FIG. 3) are executed in a similar manner, when a printing operation is performed (S101 to S103). Specifically, as illustrated in FIG. 7, at the start of print operation, the surface potential ($V_0$) of the heating roller 31 at the initial stage is measured by the surface potential measuring device 36 in the fixing device 30; subsequently, the measured value ($V_0$) is read when a decision is made in the control stage (S101). During a fixing operation in a print operation, the surface potential ($V_n$) of the heating roller 31 is measured at any given point of time (S102). Then, when a time of detection as noted above comes, the difference ΔV ($|V_n-V_0|$) for the surface potential of the heating roller 31 is calculated and it is determined whether the difference ΔV exceeds the threshold value α (15 V in this example as well) (S103).

If it is determined at step S103 that the difference ΔV for the surface potential of the heating roller 31 has exceeded the threshold value α (ΔV>α), the heating roller 31 is regarded as being in the condition where offset is liable to occur (involving a condition where calcium carbonate particles adhere to the roller), and the controller 50B starts to execute the cleaning operation using the above solid image CG1 for cleaning, after finishing all the remaining print operation in a series of print jobs requested (S114).

In this cleaning operation, the imaging device 11 forms a toner image corresponding to the full solid image CG1 for cleaning on the photoconductor drum 12 in the same way as in a normal print operation as described above. Specifically, after the data representing the full solid image CG1 is sent from the controller 50B via the image processing device 55 to the exposure unit 14, the exposure unit 14 illuminates the drum with the imaging light for forming the latent image corresponding to the full solid image CG1 for cleaning. Then, the toner image corresponding to the full solid image CG1 for cleaning is transferred to a sheet 4 of certain paper, and the sheet 4 carrying the toner image not yet fixed to the sheet is guided to pass through the contact pressing portion NB of the fixing device 30 and fixed to the sheet 4. At this time, a large amount of toner contacts with the surface of the heating roller 31, as the sheet passes through the contact pressing portion. Consequently, some of or most of clinging particles such as toner particles and particles from paper (including calcium carbonate particles) adhered to the surface of the heating roller 31 will adsorb to the toner of the solid image CG1 and will be removed from the heating roller 31. In this example, the cleaning operating is set to be executed for a succession of multiple sheets.

After the execution of the cleaning operation for a predetermined number of sheets, the controller 50B determines whether the difference ΔV for the surface potential of the heating roller 31 after the cleaning operation falls below the threshold value α (S115). The cleaning operation is repeated in a similar manner until the difference ΔV falls below the threshold value α. When it is determined that the difference ΔV has fallen below the threshold value α (ΔV<α), the cleaning operation is terminated (S116).

In this way, in the case where the difference ΔV for the surface potential of the heating roller 31 exceeds the threshold value α, the operation of cleaning the heating roller 31 is performed. Thus, the clinging particles adhered to the surface of the heating roller 31 are reduced or eliminated and the surface of the heating roller 31 is placed in the condition where the difference ΔV for its surface potential falls below the threshold value α. Thereby, in the fixing device 30, the heating roller 31 that is put in the condition where the offset is liable to occur becomes better condition where the possibility of the offset is reduced by the cleaning operation and, therefore, the offset can be prevented from occurring.

Figure 9:
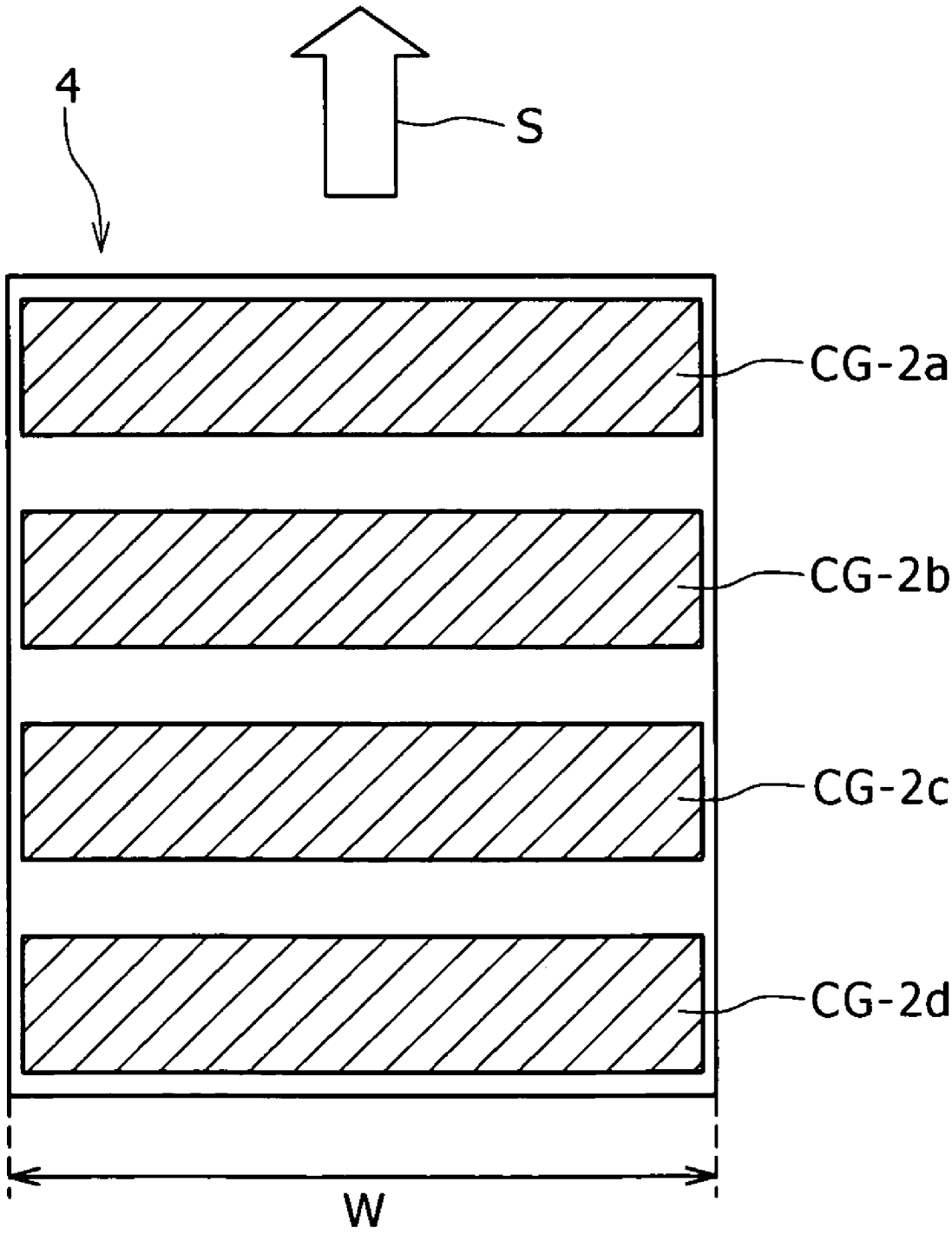
FIG. 9 is a plan view showing another example of image pattern (multiple zonal solid images) for cleaning.

In the above cleaning operation, instead of the full solid image CG-1 for cleaning (FIG. 8), for example, multiple zonal solid images CG-2*a* to CG-2*d* as illustrated in FIG. 9 may be formed. The zonal solid images CG-2*a* to CG-2*d* may be configured to fulfill the condition that any portion of the overall outer surface of the heating roller 31 contacts the toner in at least one of the multiple zonal solid images.

The above cleaning operation may be adapted such that the cleaning operation is terminated immediately after the execution of the fixing operation using the image for cleaning for a predetermined number of sheets. In particular, the control procedure of FIG. 7 can be configured such that after the operation of step S114 is finished, the procedure directly proceeds to step S116, skipping step S115.

Third Exemplary Embodiment

Figure 10:
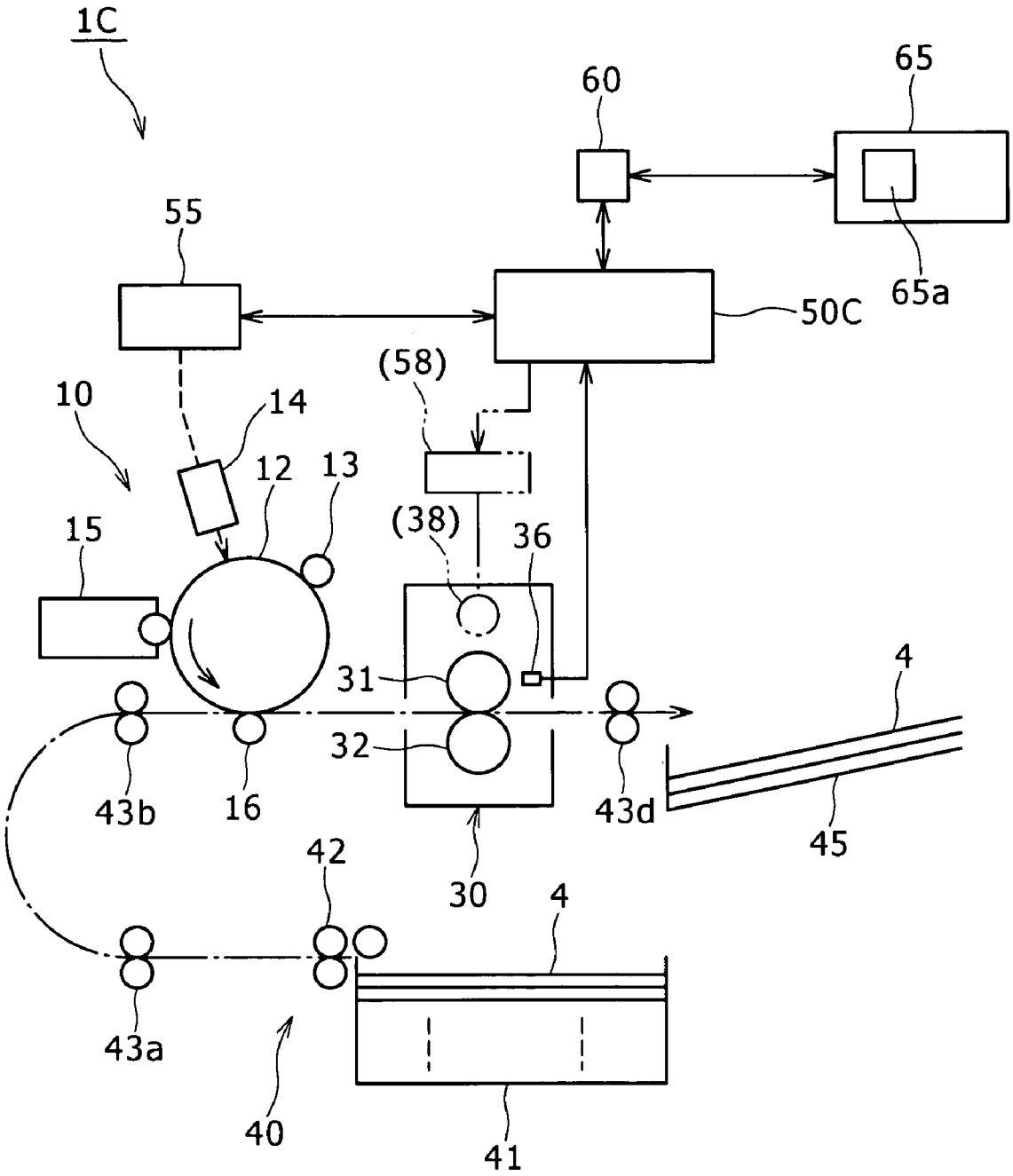
FIG. 10 is a schematic diagram showing primary elements of an image forming apparatus relevant to a third exemplary embodiment.

FIG. 10 shows an overview of an image forming apparatus relevant to a third exemplary embodiment of the present invention.

This image forming apparatus 1C is made up of the same components as those of the image forming apparatus 1A relevant to the first exemplary embodiment, except that a controller 50V is applied; a part of its control operation for preventing toner offset differs. Thus, the components corresponding to those of the image forming apparatus 1A relevant to the first exemplary embodiment are assigned the same reference numerals in FIG. 10 and a related description and their explanation will not be repeated in the following, unless necessary.

Figure 11:
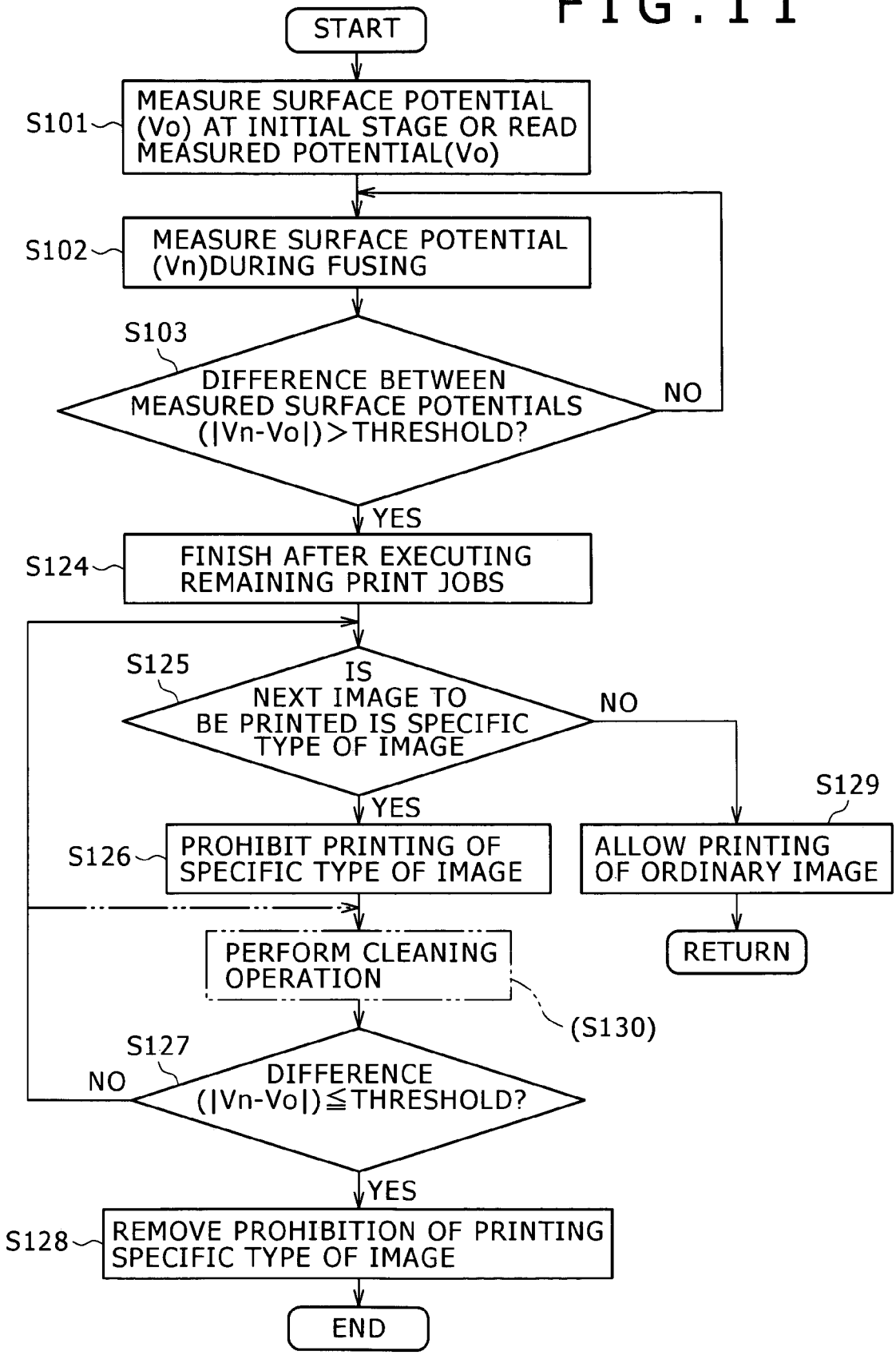
FIG. 11 is a flowchart illustrating a control operation for preventing toner offset by a controller in the image forming apparatus of FIG. 10.

The controller 50C in the third exemplary embodiment is adapted to carry out the control operation for preventing toner offset as illustrated in FIG. 11, according to the result of detection made by the surface potential measuring device 36 which measures the surface potential of the heating roller 31 of the fixing device 30. In particular, the controller 50C calculates the difference ΔV ($|V_n-V_0|$) between the surface potential ($V_0$) of the heating roller 31 at the initial stage and the surface potential ($V_n$) thereof during fixing, whenever the fixing operation takes place or each time fixing for a predetermined number of sheets has been finished, and determines whether the value of the difference ΔV has exceeded a threshold value α. If the difference has exceeded the threshold value, and if the next image to be printed is a specific type of image, the controller 50C executes an operation to inhibit the printing of that image.

Figure 12:
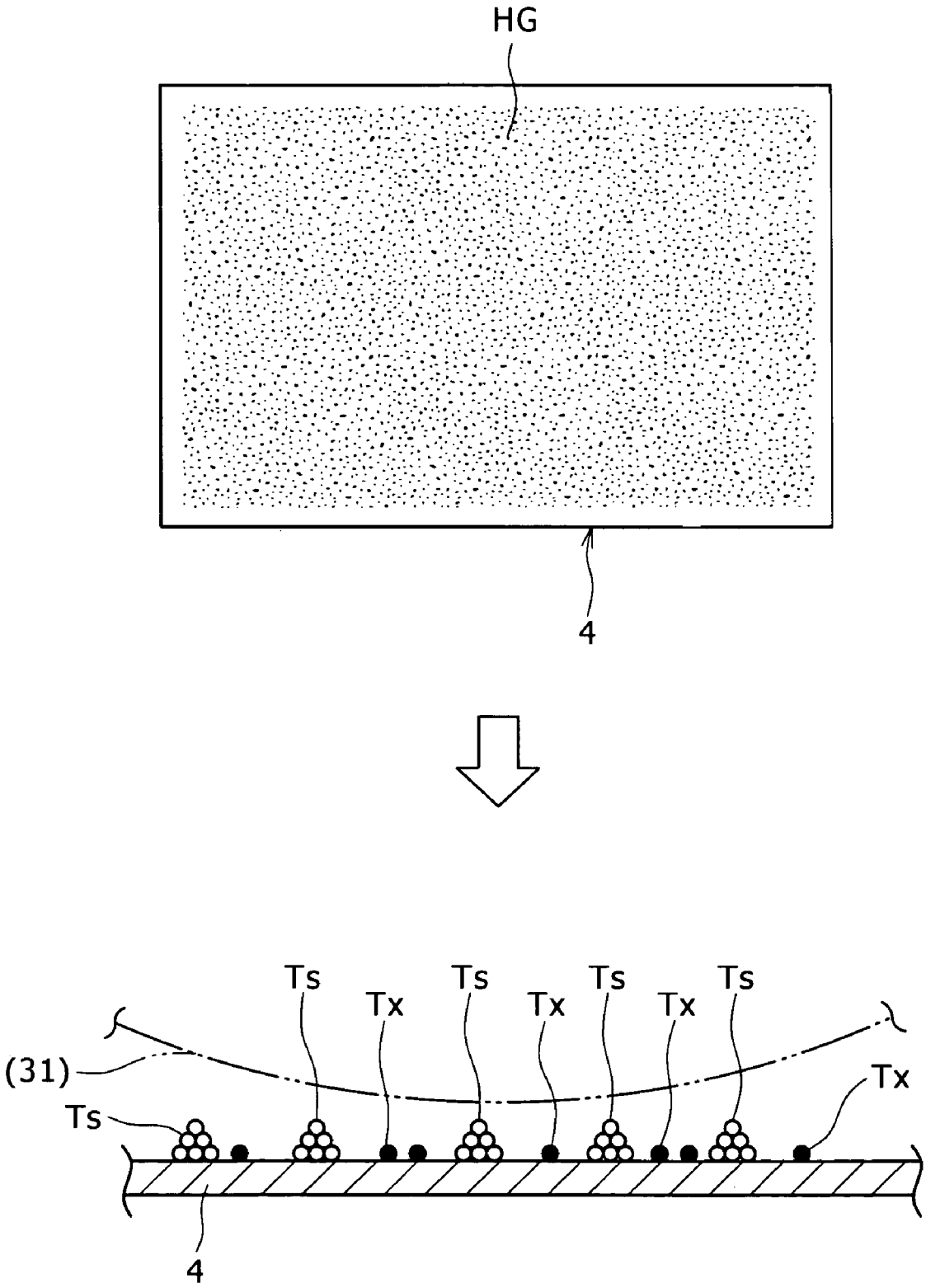
FIG. 12 is a plan view showing an example of a specific type of image (a halftone image) and the state of toner particles constituting the image with an enlarged sectional view of a part thereof.
Figure 13:
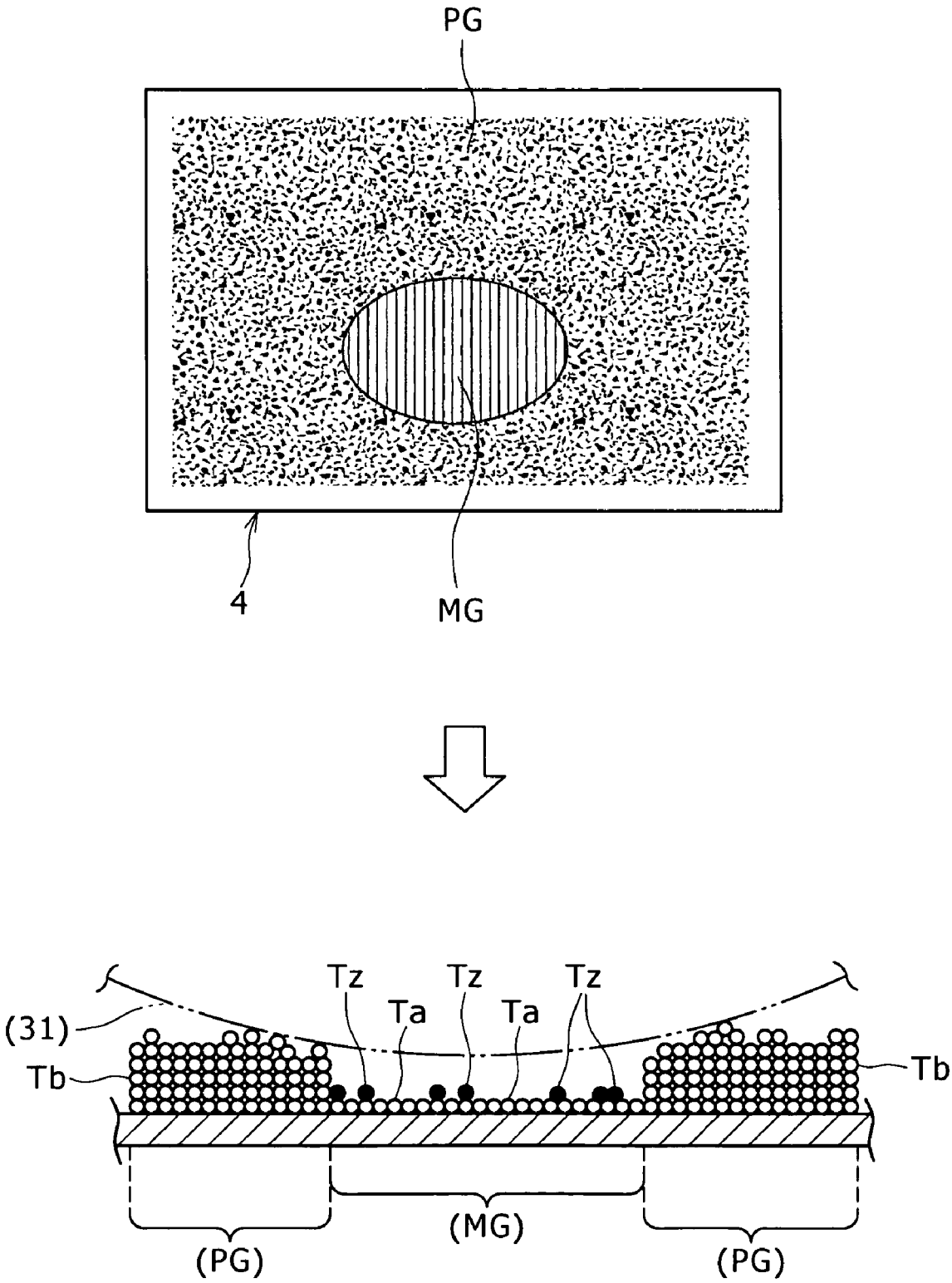
FIG. 13 is a plan view showing an example of a specific type of image (a photograph image including a halftone image) and the state of toner particles constituting the image with an enlarged sectional view of a part thereof.

In this example, specific types of image for which printing is inhibited are specifically a halftone image HG as illustrated in the upper part of FIG. 12 or an image including it (HG) and a photograph image PG including a halftone portion MG as illustrated in the upper part of FIG. 13. The image processing device 55 determines whether the image to be processed is such a specific type of image. Particularly, as for a photograph image PG including a halftone portion MG, such type of image can be determined from the original image data obtained.

Here, a halftone image HG is made up of multiple toner clusters Ts scattered as halftone dots and a possible undesirable state thereof is that discrete toner particles Tx are present between the toner clusters Ts, resulting from a phenomenon such as toner scattering, as illustrated by an enlarged view of a part of this image shown in the lower part of FIG. 12. When fixing such a halftone image HG, discrete toner particles Tx as shown in the lower part of FIG. 12 are placed in a state where they exist in clearances between the surface of the heating roller 31 and the sheet 4 in the contact pressing portion NP of the fixing device 30. There is thus a high possibility that these particles are attracted toward the surface of the heating roller 31 by electrostatic action and transfer and cling to the roller surface. In short, toner offset is liable to occur.

A photograph image PG including a halftone portion MG may also assume a state in which a layer of toner particles Ta constituting the halftone portion MG exits as a recess portion relatively lower than a layer of toner particles Tb constituting the photograph image PG and tone particles Tz are present on the bottom of the recess of the halftone portion MG, as illustrated by an enlarged view of a part of this image shown in the lower part of FIG. 13. When fixing the photograph image PG including such a halftone portion MG, the discretely scattered toner particles Tz as shown in the lower part of FIG. 13 are placed in a state where they exist in a clearance between the surface of the heating roller 31 and the toner (layer Ta) on the sheet 4 in the contact pressing portion NP of the fixing device 30. There is thus a high possibility that these particles are attracted toward the surface of the heating roller 31 by electrostatic action and transfer and cling to the roller surface. In short, toner offset is liable to occur.

Next, the control operation for preventing toner offset by the controller 50C in the image forming apparatus 1C is described with reference to FIG. 11.

First, the initial steps of the control operation by the controller 50A in the first exemplary embodiment (steps S101 to S103 in FIG. 3) are executed in a similar manner as shown in FIG. 11, when a printing operation is performed (S101 to S103). This is the same as for the second exemplary embodiment (FIG. 7).

If it is determined at step S103 that the difference ΔV for the surface potential of the heating roller 31 has exceeded the threshold value α (ΔV>α), the heating roller 31 is regarded as being in the condition where offset is liable to occur (involving a condition where calcium carbonate particles adhere to the roller). If the next image to be printed is a specific type of image for which printing is inhibited, the controller 50C executes the control operation to inhibit printing of that image (S125-S126), after finishing all the remaining print operation in a series of print jobs requested (S124).

Specifically, the control operation at this time is as follows. It is determined whether the next image to be printed is a specific type of image for which printing is inhibited, according to the data from the image processing device 55 (S125). If the next image to be printed is either a "halftone image HG or an image including it (HG) (FIG. 12)" or a "photograph image PG including a halftone portion MG" as mentioned above, the printing operation for the specific type of image is inhibited (S126). When this printing operation is inhibited, for example, the control procedure may be adapted to display the message of the printing inhibition on the display 65*a* of the operation and display console.

During the inhibition of printing of the specific type of image, it is determined whether the difference ΔV for the surface potential of the heating roller 31 after the printing inhibition falls below the threshold value α (S127). When it is determined that the difference ΔV has fallen below the threshold value α (ΔV<α), the inhibition of printing of the specific type of image is removed (S128). This is because of the following. Even when printing of a specific type of image is inhibited, if the next image to be printed is an ordinary image other than the specific type of image, a printing operation of that image is allowed to be executed (S129). By executing printing of the normal image, the condition of the surface of the heating roller 31 may change (for example, a part of calcium carbonate particles adhered to the roller may be removed by the toner) and the difference ΔV for its surface potential may fall below the threshold value α.

In this way, if the difference ΔV for the surface potential of the heating roller 31 has exceeded the threshold value α, the control operation is executed to inhibit printing of a specific type of image which tends to cause toner offset. Thus, even if the heating roller 31 has been put in a condition where toner offset is liable to occur, printing of a specific type of image which tends to cause toner offset is inhibited. In consequence, during the inhibition of printing of a specific type of image, the fixing device 30 does not execute fixing for a toner image constituting the specific type of image being in the condition where toner offset is apt to occur and, therefore, the offset can be prevented from occurring. In this case, because printing of an ordinary image other than specific types of image is executable as usual, there is no negative influence on the printing operation.

The control procedure for this image forming apparatus 1C may be configured as follows. After the execution of the control operation to inhibit printing of a specific type of image, a cleaning operation for the heating roller 31 is executed (S130), as indicated by a two-dot chain line in FIG. 11. After the cleaning operation, it is determined whether the difference ΔV for the surface potential of the heating roller 31 falls below the threshold value α (S127). When it is determined that the difference ΔV has fallen below the threshold value α (ΔV<α), the inhibition of printing of the specific type of image is removed (S128). In the case of doing so, the heating roller 31 may be cleaned by a dedicated cleaning device 38. Consequently, the difference ΔV for the surface potential of the heating roller 31 will sooner fall below the threshold value α and the inhibition of printing of the specific type of image can be removed in a shorter time.

In this case, the cleaning operation for the heating roller 31 may be configured as follows. As is the case for the second exemplary embodiment, fixing of an image for cleaning may be executed for a predetermined number of sheets. Alternatively, the cleaning device 38 for cleaning the heating roller 31 may be installed in the fixing device 30 so as to be operable by its drive controller 58 only during the inhibition of printing of a specific type of image. In the latter case, as the cleaning device 38, a well-known cleaning web type device or a cleaning roller type device may be applied. The cleaning device 38 may be configured with a retractable mechanism or the like such that the device is moved to a position where it contacts the heating roller 31 so as to be able to clean the roller only during cleaning and moved back to a retraction position apart from the heating roller 31 at off time.

Other Exemplary Embodiments

In the first to third exemplary embodiments, as the fixing device 30 illustrated, a roller nip type is used in which a pair of rollers 31, 32 are contact pressed against each other to define the contact pressing portion NP for fixing; however, the fixing device is not limited to this type. For example, it is possible to use a fixing device employing a belt structure member to rotate the heating roller 31 and/or the pressure roller 32.

Although the imaging device 11 which forms a single-color image (toner image) has been illustrated, an imaging device configured to form a multicolor image may be used. In the case of using the imaging device 11 that forms a multicolor image, the imaging device may be as a type including an intermediate transferring member such as a belt form or drum form.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus, comprising:

an imaging device that forms a toner image based on image data and transfers the toner image to a recording medium;

a fixing device comprising a pair of rotatable members that defines a contact pressing portion that allows the recording medium with the toner image to pass through, and heats and presses the recording medium with the toner image;

a surface potential measuring device that measures a surface potential of at least one of the pair of rotatable members; and a controller that performs control to give an alert notification that at least one of the pair of rotatable members which contacts with the toner image to be fixed should be replaced, when a result of the surface potential measured by the surface potential measuring device has exceeded a predetermined value.

2. The image forming apparatus according to claim 1, wherein the at least one of the pair of rotatable members which contacts with the toner image to be fixed comprises thereon a surface release layer formed of a fluorinated resin including a filler.

3. The image forming apparatus according to claim 1, the predetermined value referenced by the controller is a difference between an initial surface potential measured by the surface potential measuring device and a lowest surface potential when an action in which toner particles are electrostatically attracted toward the rotatable member takes place.

4. An image forming apparatus, comprising:

an imaging device that forms a toner image based on image data and transfers the toner image to a recording medium;

a fixing device comprising a pair of rotatable members that defines a contact pressing portion that allows the recording medium with the toner image to pass through, and heats and presses the recording medium with the toner image;

a surface potential measuring device that measures a surface potential of at least one of the pair of rotatable members; and a controller that executes an operation for cleaning at least one of the pair of rotatable members which contacts with the toner image to be fixed, when a result of the surface potential measured by the surface potential measuring device has exceeded a predetermined value.

5. The image forming apparatus according to claim 4, wherein the operation for cleaning comprises forming a predetermined toner image pattern by the imaging device and transporting a recording medium with the predetermined toner image pattern transferred thereto to pass through the contact pressing portion defined by the pair of rotatable members in the fixing device.

6. The image forming apparatus according to claim 4, wherein the predetermined toner image pattern includes a solid image formed across an entire width of the recording medium as at least a part thereof.

7. The image forming apparatus according to claim 4, further comprising a cleaning member that cleans a surface of at least one of the pair of rotatable members which contacts with the toner image to be fixed, wherein the apparatus performs control the cleaning member to clean the at least one rotatable member which contacts with the toner image to be fixed, when a result of the surface potential measured by the surface potential measuring device has exceeded a predetermined value.

8. An image forming apparatus, comprising:

an imaging device that forms a toner image based on image data and transfers the toner image to a recording medium;

a fixing device comprising a pair of rotatable members that defines a contact pressing portion that allows the recording medium with the toner image to pass through, and heats and presses the recording medium with the toner image;

a surface potential measuring device that measures a surface potential of at least one of the pair of rotatable members; and a controller that performs control to inhibit formation of a toner image of a specific type by the imaging device, when a result of the surface potential measured by the surface potential measuring device has exceeded a predetermined value.

9. The image forming apparatus according to claim 8, wherein the specific type of image is an image that has a possibility of providing a state where transferred toner particles are scattered on the recording medium or a state where the transferred toner particles exist on a bottom of a relatively recessed toner image portion.

10. The image forming apparatus according to claim 8, wherein the specific type of image includes a halftone image.

11. A method of recommending replacement of at least one of a pair of rotatable members in a fixing device which fuses and fixes a toner image to a recording medium, the method comprising:

measuring a surface potential of at least one of the pair of rotatable members; and recommending the replacement of at least one of the pair of rotatable members which contacts with the toner image to be fixed, when a result of the measured surface potential has exceeded a predetermined value.

12. The method of recommending the replacement according to claim 11, wherein the predetermined value is a difference between an initial surface potential measured and a lowest surface potential when an action in which toner particles are electrostatically attracted toward the rotatable member for image fixing takes place.

13. A method of cleaning at least one of a pair of rotatable members in a fixing device which fuses and fixes a toner image to a recording medium, the method comprising:

measuring a surface potential of at least one of a pair of rotatable members; and cleaning a surface of at least one of the pair of rotatable members which contacts with the toner image to be fixed, when a result of the measured surface potential has exceeded a predetermined value.

14. The method of cleaning according to claim 13, wherein the predetermined value is a difference between an initial surface potential measured and a lowest surface potential when an action in which toner particles are electrostatically attracted toward the rotatable member for image fixing takes place.

15. A method of controlling image formation in an image forming apparatus which comprises an imaging device and a fixing device and forms a toner image on a recording medium, the method comprising:

measuring a surface potential of at least one of a pair of rotatable members in the fixing device; and inhibiting formation of a toner image of a specific type, when a result of the measured surface potential has exceeded a predetermined value.

16. The method of controlling image formation according to claim 15, wherein the predetermined value is a difference between an initial surface potential measured and a lowest surface potential when an action in which toner particles are electrostatically attracted toward the rotatable member for image fixing takes place.

17. The method of controlling image formation according to claim 15, wherein the specific type of image is an image that has a possibility of providing a state where transferred toner particles are scattered on the recording medium or a state where the transferred toner particles exist on a bottom of a relatively recessed toner image portion.

18. The method of controlling image formation according to claim 15, wherein the specific type of image includes a halftone image.

* * * * *